United States Patent [19]

West

[11] 4,208,816

[45] Jun. 24, 1980

[54] TOOTH ADAPTOR

[75] Inventor: Donald J. West, Thornleigh, Australia

[73] Assignee: J. I. Case Company, Racine, Wis.

[21] Appl. No.: 927,761

[22] Filed: Jul. 25, 1978

[30] Foreign Application Priority Data

Jul. 25, 1977 [AU] Australia ..... PD0959

[51] Int. Cl.[2] ..... E02F 9/28

[52] U.S. Cl. ..... 37/141 R; 299/91

[58] Field of Search ..... 37/141 R, 141 T, 142 R, 37/142 A; 299/91

[56] References Cited

U.S. PATENT DOCUMENTS 3,947,982 4/1976 Mantovani ..... 37/141 R

*Primary Examiner*—E. H. Eickholt

*Attorney, Agent, or Firm*—Cullen, Sloman, Cantor, Grauer, Scott & Rutherford

[57] ABSTRACT

A tooth adaptor, which is welded upon the cutting edge surface portion of an earth moving bucket, is provided with oppositely extending lateral wings. The weld extends along the rear edges of the wings and the peripheral edge of the adaptor rearwardly of the wings, wherein the weld is protected by the wings.

3 Claims, 5 Drawing Figures

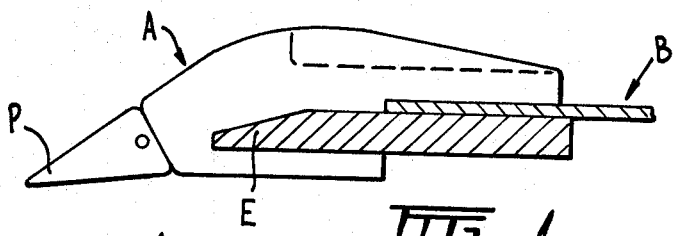
FIG. 1.
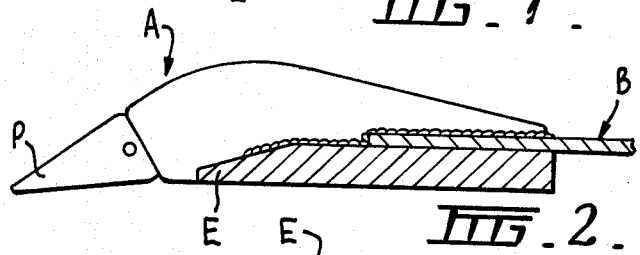
FIG. 2.
FIG. 3.
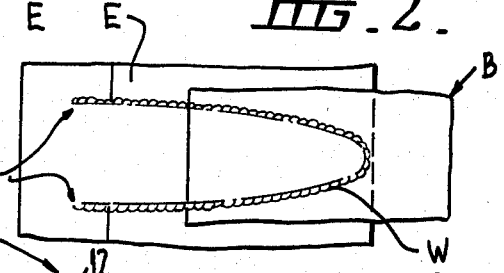
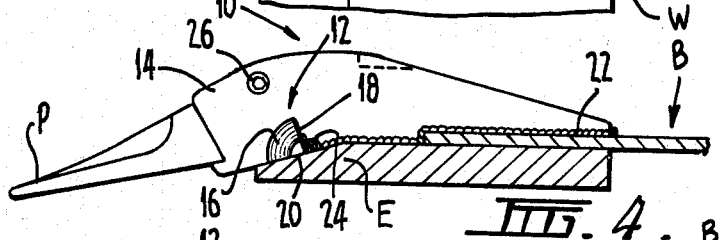
FIG. 4.
FIG. 5.
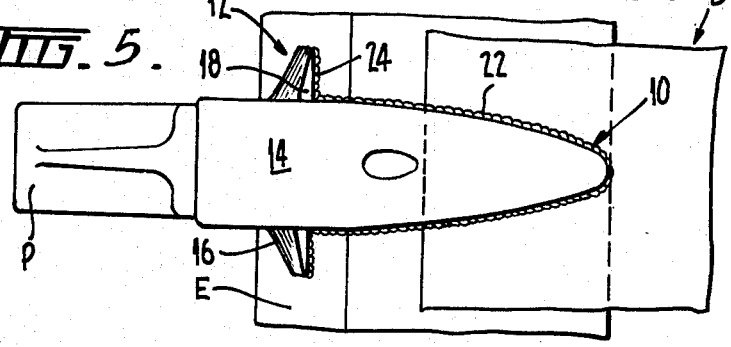

TOOTH ADAPTOR

This invention relates to replaceable tooth adaptors for earth moving buckets such as backhoe buckets, clamshell buckets and loader buckets.

Most conventional replaceable tooth adaptors are constructed to engage the cutting edge of the loader or other earth moving bucket both above and below the cutting edge and are held in place by welding or by bolts. When a smooth floor is required on the bucket, the adaptor is welded to the bucket at the top only leaving the bottom of the bucket flush.

One major disadvantage with such arrangements is that the weld attaching the adaptor to the bucket tends to commence tearing at the forward extremity of the weld where the weld is often thin in section due to weld run off and due to the fact that the weld must remain clear of the cutting edge to avoid stress concentrations and thermal shock in this area.

It is the object of the invention to provide an improved tooth adaptor which at least to a large extent overcomes the above disadvantage.

The invention therefore provides a replaceable tooth adaptor for an earth moving bucket comprising an adaptor body having means, such as a socket or spigot, for supporting a replaceable tooth or point, said body having oppositely extending lateral wings adjacent the front end of the body.

The provision of lateral wings on the adaptor body enables the adaptor to be secured to a bucket by welding around the body and behind the wings. Since the wings are in use near the front of the adaptor the securement of the adaptor to the bucket is substantially strengthened by the build up of weld metal at the front edge of the bucket between the wings and the bucket. Unlike the prior art described above, this weld is protected against abrasion by the wings. Thus, not only is the weld less likely to tear than the prior art but is likely to have a longer life due to its protection against abrasion.

One preferred form of the invention will now be described with reference to the accompanying drawings in which:

FIG. 1 is a side elevation of a conventional tooth adaptor fitted to a bucket;

FIG. 2 is a side elevation of a flush-fitted prior art adaptor;

FIG. 3 is a schematic plan view of the weld connection in FIG. 2;

FIG. 4 is a side elevation of a tooth adaptor embodying the invention fitted to a bucket and supporting a replaceable point, and FIG. 5 is a plan view of the adaptor in FIG. 4 showing its welded attachment to the bucket.

A conventional adaptor A supporting a replaceable point P is shown somewhat schematically in FIG. 1 of the drawings. It will be noted that the adaptor A is formed to engage the cutting edge E of the bucket B both above and below. The adaptor A is attached to the bucket by bolts or by welding in the usual manner.

FIG. 2 of the drawings shows another prior art adaptor construction in which the adaptor A is attached to the bucket B by welding at the top surface only leaving the underside of the replaceable tooth or point P generally flush with the bottom of the cutting edge of the bucket.

The general configuration of the weld W attaching the adaptor of FIG. 2 to the bucket is shown in FIG. 3. It is usual for the weld to be thin at the leading edges L of the weld W for the reasons referred to above and as a result the forces encountered during the use of the bucket B tend to tear the adaptor A away from the bucket B at the leading edge L of the weld W.

FIGS. 4 and 5 of the drawings show an adaptor embodying the present invention and as will be clear from these Figures, the improved adaptor 10 has oppositely extending lateral wings 12 adjacent its front or leading end, these wings 12 being formed as integral castings with the remainder of the body 14 of the adaptor 10. In the form shown in the drawings, the wings 12 have a smoothly rounded leading face 16, a flat trailing face 18 and a flat support surface 20 which rests in use on the cutting edge E of the bucket B. The wings 12 taper generally uniformly from their connection to the adaptor body 14 and this in combination with the smoothly rounded leading face 16 reduces to a minimum any resistance that may be created by the wings 12.

The adaptor body 14 is attached to the bucket B by means of a weld 22 in the area shown in FIGS. 4 and 5. As shown most clearly in FIG. 4, there is a build-up 24 of weld metal 22 behind each wing 12 extending generally perpendicularly to the body 14 of the adaptor 10 and transversely of the line of working movement of the bucket B. This weld metal build-up 24 is additional to the usual weld metal around the perimeter of the adaptor body 14 and substantially strengthens the attachment of the adaptor 10 to the bucket B. Furthermore, the additional weld metal 24 is protected against abrasion in use by means of the wings 12.

The adaptor body 14 is formed with a socket (not shown) in the usual manner to receive the replaceable tooth P and a pin or the like 26 is used to hold the tooth P in position. Alternatively, the adaptor body 14 may be formed with a spigot which is received within a socket in the tooth P.

While one particular configuration of adaptor body and wings has been described herein, it will be appreciated that other configurations may be used without departing from the essence of the present invention. Similarly, while the wings in the preferred embodiment are integrally cast with the adaptor body, it may be possible to form the wings separately and attach them to the body either by welding or by some other attachment means. Of course, the formation of the body and wings as an integral casting is preferred for obvious reasons. Furthermore, while the wings are shown as extending generally perpendicularly from the adaptor body, there may be some advantage in having the wings extend at some other acute angle to the adaptor body.

I claim:

1. An earth working bucket having a beveled cutting edge, a tooth adaptor secured to said bucket at said bucket cutting edge, said adaptor having an elongated body overlying said bucket cutting edge for receiving a replaceable point having a leading end extending beyond said bucket cutting edge, said adaptor body having a pair of oppositely extending wings spaced from said adaptor leading end, said wings each having a smoothly rounded leading face spaced inwardly from said bucket cutting edge, said wings tapering in cross section from said body to a smaller cross section at their ends, said adaptor secured to said bucket by a weld extending around the periphery of said body and behind said wings, said weld spaced from said bucket cutting edge, the weld thus being protected by said wings and said wings strengthening the attachment of said adaptor to said bucket.

2. The earth working bucket defined in claim 1, wherein the leading face of said wings are generally cone-shaped, said wings tapering rearwardly from adjacent said bucket cutting edge and the trailing edge of said wings, which receive said weld, being flat and generally transverse to said bucket.

3. The earth working bucket defined in claim 2, wherein said wings overlie the bevel of said bucket cutting edge, but are spaced from said cutting edge.

* * * * *